US005791265A

United States Patent [19]

Ellsworth et al.

[11] Patent Number: 5,791,265

[45] Date of Patent: Aug. 11, 1998

[54] SELECTIVELY VARIABLE MODULAR SPACE SYSTEM WITH SHELVING

[76] Inventors: Arthur W. Ellsworth, 23351 Madero St., Mission Viejo, Calif. 92691; John C. Moore, 710 Thalia St., Laguna Beach, Calif. 92651

[21] Appl. No.: 655,419

[22] Filed: May 30, 1996

[51] Int. Cl.[6] ..... A47B 45/00

[52] U.S. Cl. ..... 108/180; 211/194; 312/108; 312/265.4

[58] Field of Search ..... 211/188, 194, 211/181; 108/180, 181, 92, 91, 153; 312/107, 108, 265.4, 265.3, 265.2, 265.1, 184, 328, 327, 326, 329; 403/397, 391, 396, 388

[56] References Cited

U.S. PATENT DOCUMENTS

| | | | |
|---|---|---|---|
| 403,168 | 5/1889 | Wood | 312/265.4 |
| 3,419,319 | 12/1968 | Jentzen | 312/265.4 |
| 4,117,783 | 10/1978 | Eckel et al. | 211/194 X |
| 4,118,081 | 10/1978 | Barrientos | 312/328 |
| 4,191,436 | 3/1980 | Cherry | 312/265.1 X |
| 4,434,899 | 3/1984 | Rivkin | 211/181 X |
| 4,774,792 | 10/1988 | Ballance | 403/391 X |
| 4,846,078 | 7/1989 | Janson | 312/257.1 X |

FOREIGN PATENT DOCUMENTS

| | | | |
|---|---|---|---|
| 637235 | 12/1963 | Belgium | 211/188 |
| 2403893 | 5/1979 | France | 211/194 |
| 1121585 | 1/1962 | Germany | 312/184 |
| 810752 | 3/1959 | United Kingdom | 312/107 |
| 2137871 | 10/1984 | United Kingdom | 312/108 |

*Primary Examiner*—Jose V. Chen
*Assistant Examiner*—Janet M. Wilkens
*Attorney, Agent, or Firm*—Lyon & Lyon LLP

[57] ABSTRACT

A modular space system is shown and described. The system includes open-sided modular frames stacked together to form open-sided columns, the upper frames having the same width but smaller depth than that of the frames on which they rest, thereby enhancing stability. Shelving elements of varying, selected dimensions extend through guide openings in the frames to lock the columns together and provide horizontal work and storage surfaces. Snap-on frames are selectively attached to the modular frames to provide support for a variety of accessories, including file folders and drawers.

15 Claims, 10 Drawing Sheets

SELECTIVELY VARIABLE MODULAR SPACE SYSTEM WITH SHELVING

BACKGROUND OF THE INVENTION

1. Field of the Invention

The present invention relates generally to a space system such as for accommodating document files, books, business equipment, computer equipment including peripherals, photographs, and any number of other general miscellaneous items typically found in an office, or room in a home, which system includes different sized modules that can be selectively intermounted to one another in order to conform to available room space.

2. Description of Related Art

As used herein the term "space system" or "space unit" relates to a system or unit to be located in a room, either domestic or office, which supports objects of great variety in a visible and organized manner. Probably the most frequently encountered space unit is a table onto which objects to be displayed or for ready retrieval are stacked. Such tables typically are of fixed geometry and size limiting their application both practically and to accord with a certain desired aesthetical effect.

A further conventional system for accommodating such things as document files, is to provide cabinets with sides, top and bottom, and sliding drawers or drawer sides which can swing open providing access to the interior space where items are located out of normal view. Not only are cabinets relatively heavy and bulky, they have preferred access points (e.g., doors and drawers) via which access to the interior can only be made. Moreover, when a number of such cabinets are utilized and located within a given room, it will be found that because of restricted manner of access to the interior of the cabinets only a limited space arrangement the cabinets exists precluding efficient use otherwise of the room space. Still further, such filing cabinets are of fixed design offering only a limited flexibility in use which is namely to move the cabinets from one location to another, but otherwise not being able to change their given size and shape and side of accessibility.

There are other known units having variable constructional aspects providing more flexible utilization and space accommodation capabilities. Exemplary of such prior solutions to these problems is U.S. Pat. No. 4,117,783, MODULAR STORAGE UNIT, by L. B. Eckel et al. which although disclosing a modular support unit of some flexibility, it is not completely satisfactory from an overall space utilization standpoint, in particular.

SUMMARY OF THE INVENTION

It is a primary aim and object of the present invention to provide an improved space system of considerable flexibility which can accommodate selective range of different typical personal and business files, books, and equipment and at the same time conform to a wide range of available room space configurations.

In accordance with another object, there is provided a system in accordance with the above object which includes open wall tubular modules of different sizes which can be vertically stacked onto one another forming columns and the columns interrelated by one or more shelving elements.

Another object is to provide a space system as in the previous objects including a plurality of modules of differing cross-sectional dimensions which can be selectively arranged in a number of stacked columns interrelated by shelving.

Yet another object of the invention is to provide a space system as in the previous objects including first modules for ground plane location, second modules for resting assembly on the first modules, said second modules being of reduced cross-sectional dimensions so as to increase system stability.

In accordance with a preferred embodiment of the invention, a first modular frame is provided constructed of individual rod-like elements interconnected to form a relatively rigid, generally parallelepiped construction. A second modular frame is similarly constructed to the first modular frame, with lower parts enabling stable resting receipt onto the top of an underlying first modular frame. The upwardly extending part of the second modular frame has reduced cross-sectional dimensions as compared to the first frame.

The first and second frame when mounted onto one another form a column having confining guide slots through which shelving elements are located. A third modular frame is generally rectangular with a pair of opposite edges located out of the plane of the remainder for receipt onto the top of an uppermost first or second frame to provide guide slots for topmost shelving between adjacent modular columns.

In another aspect of the invention sets of the different modular frames are made in different cross-sectional dimensions (e.g., 12, 16 and 24 inches square), separate columns being stacked from like dimensioned modular frames and the various columns being related by shelving.

BRIEF DESCRIPTION OF THE DRAWING

The above described objects and advantages of the present invention will become more readily apparent upon reference to the detailed description that follows with reference to the attached drawings, in which.

DESCRIPTION OF A PREFERRED EMBODIMENT

Figure 1:
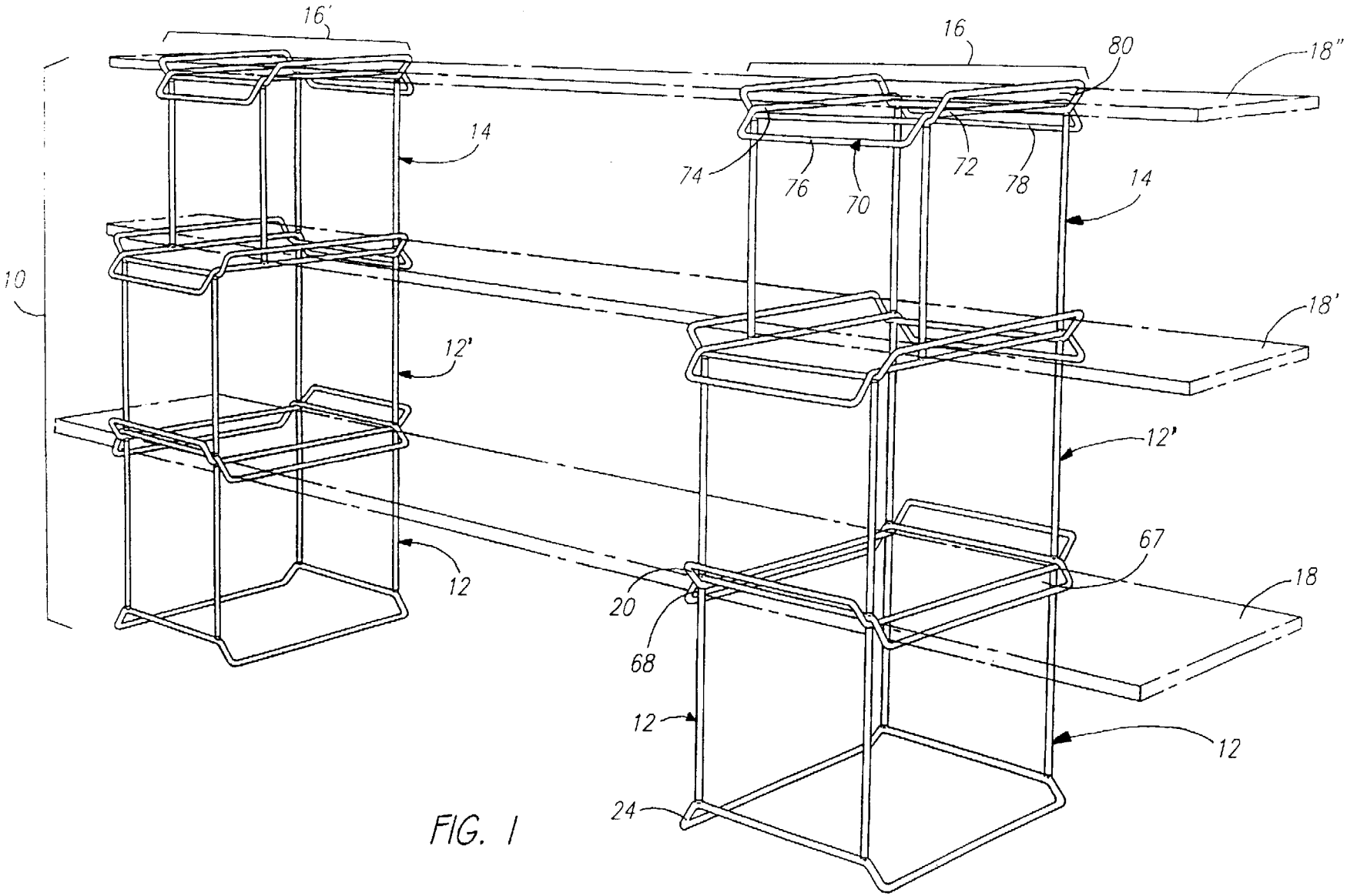
FIG. 1 is a perspective view of one version of space system of the present invention.

In the ensuing detailed description of a preferred embodiment of the invention, reference is made to the drawing and initially particularly to FIG. 1. As shown there, the system 10 to be described includes a plurality of first and second open-sided modular frames 12 and 14, respectively, assembled together to provide a number of separate columns 16, 16' for example, the lowermost modular frame resting on a suitable ground plane (e.g., floor) which is not shown. Moreover, in a way that will be more particularly described, one or more shelving elements 18, 18', 18" removably interrelate two or more columns, which shelving elements can support and display a miscellany of equipment, files, books or other objects on an upwardly directed surface.

Figure 2:
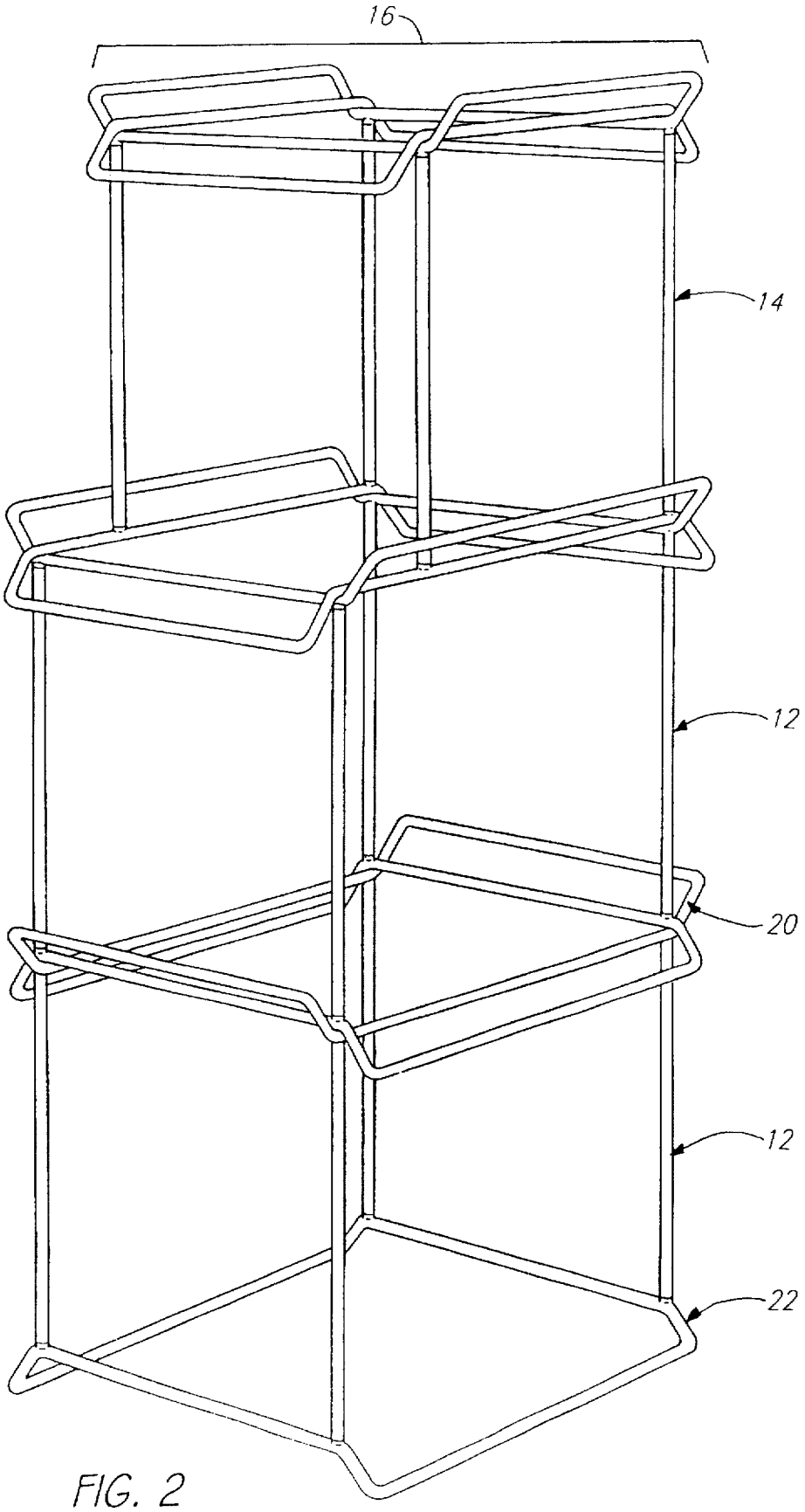
FIG. 2 is a perspective view of one form of column of the present invention.
Figure 3:
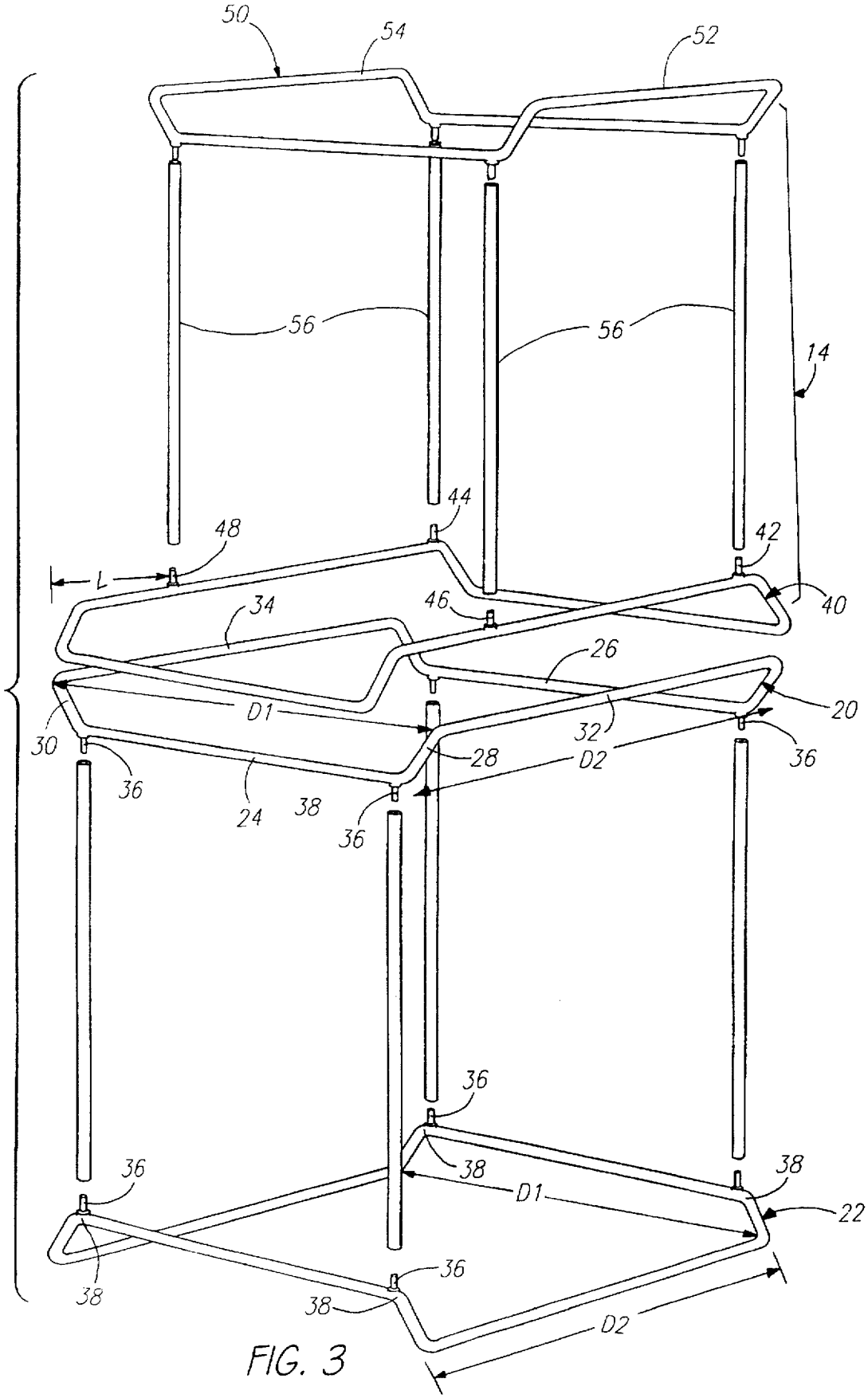
FIG. 3 depicts in exploded view two forms of modular frames this invention.

With simultaneous reference to FIGS. 2 and 3, the first modular frame 12 is seen to include an upper base 20 and lower base 22, both of rectangular geometry and constructed from metal tubes or rods which form the outer sides of the bases. More particularly, the upper base 20 is constructed of a single tube or rod formed into first and second spaced-apart equilength parallel sides 24 and 26 which have end portions 28 and 30 that are bent upwardly at an angle to join third and fourth parallel base sides 32 and 34, respectively. Accordingly, the base 20 has its sides 24, 26 forming a plane that is parallel to and spaced from the plane formed by the third and fourth sides 32,34. Also, the third and fourth sides are spaced from one another a distance D1 that is greater than the spacing D2 between the first and second sides. When formed from a single rod or tube, the two opposite rod ends are preferably welded together (not shown) to form a rigid and strong closed-loop construction.

The lower base 22 is constructed the same as base 20 except that the bent end portions occur on the other opposed sides than in those of base 20. For example, if the end portions of the longer sides are bent on base 20, then the bent end portions will preferably occur on the shorter sides of base 22 (FIGS. 1, 2).

A stub shaft 36 is welded at each of the approximate four corner points 38 of the bases 20 and 22 where the bending is accomplished to provide the end portions 28 and 30, only extending in a direction opposite to that of the bent portions (FIG. 3).

In assembly of a modular frame 12, four identical support tubes 39 (or optionally rods having a shallow axial opening in each end) have their ends received onto the stub shafts 36 of facing upper and lower bases 20 and 22 to form the overall parallelepiped form of the modular first frame 12.

Figure 5:
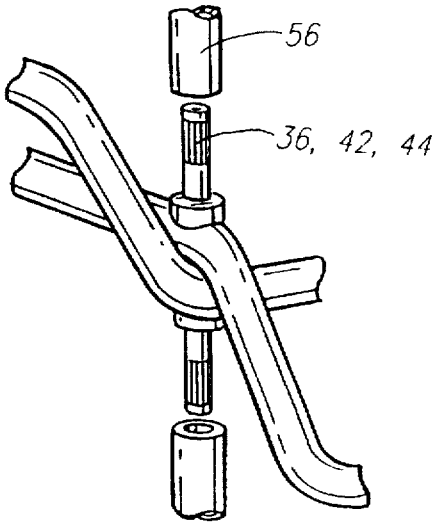
FIG. 5 is an enlarged, partially fragmentary, detailed view of contact areas for two stacked modular frames.
Figure 6:
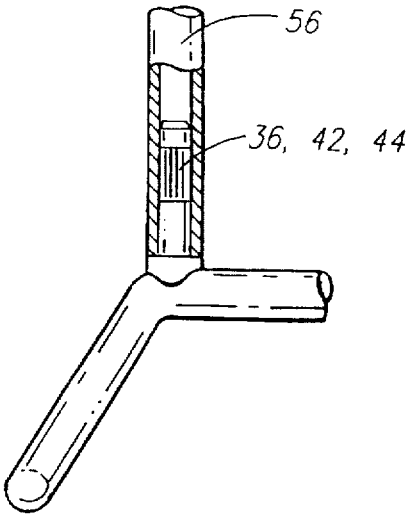
FIG. 6 is a sectional, partially fragmentary view of a support tube assembled to a modular frame.

The second modular frame 14 is constructed with an eye toward being restingly mounted onto the upper base 20 of a first modular frame 12 in a relatively stable configuration. The second frame lower base 40 should be constructed of geometry and dimensions identical to the first frame lower base 22 except that whereas two stub shafts 42 and 44 are located at bending points of one base side, the remaining two stub shafts 46 and 48 are positioned inwardly from the pair of bending points of the opposite side a predetermined distance L. The second frame upper base 50 is constructed identically to the first frame upper base 20 except that its sides 52 and 54 are of reduced length permitting assembly via vertical support tubes 56 having their lowermost ends received onto stub shafts 42–48, as further illustrated in FIGS. 5 and 6.

It is important to note that the lower base 22 of frame 12 has its bent end portions extending downwardly so that the frame 12 is resting on a ground plane solely on two opposite sides with the other two intervening sides being held spaced from the ground plane. On the other hand, the upper base 20 of frame 12 has its bent end portions extending upwardly away from the lower base 22. Similarly, the lower base for each modular frame 14 has its bent end portions extending downwardly while the upper base bent arm portions extend upwardly. These aspects of the two modular frames are maintained throughout the various frame assemblies to be described below.

With reference once again to FIG. 2, there is depicted a single column 16 including a first modular frame 12 resting on a ground plane (not shown), and a further first frame 12' having its lower base resting on the upper base of frame 12. Also, it is to be noted that bent portions of the lower base of frame 12' extend downwardly and outwardly of the upper base for frame 12, while at the same time the bent end portions of the frame 12 upper base extend upwardly about the sides of the lower base of frame 12'. This arrangement results in a locking condition of the two frames against either relative rotation or relative translation of the frames, although the two frames may be readily lifted apart.

Finally, a second modular frame 14 is restingly located on the upper base of frame 12' in the same way as just described in connection with the assembly of frame 12' onto frame 12. In addition to the locking action against relative rotation and translation for the three-frame column of FIG. 2, since the uppermost frame 14 is of reduced cross-sectional dimensions, the columnar structure is more stable than if the dimensions were equal to those of the underlying frame.

Figure 4:
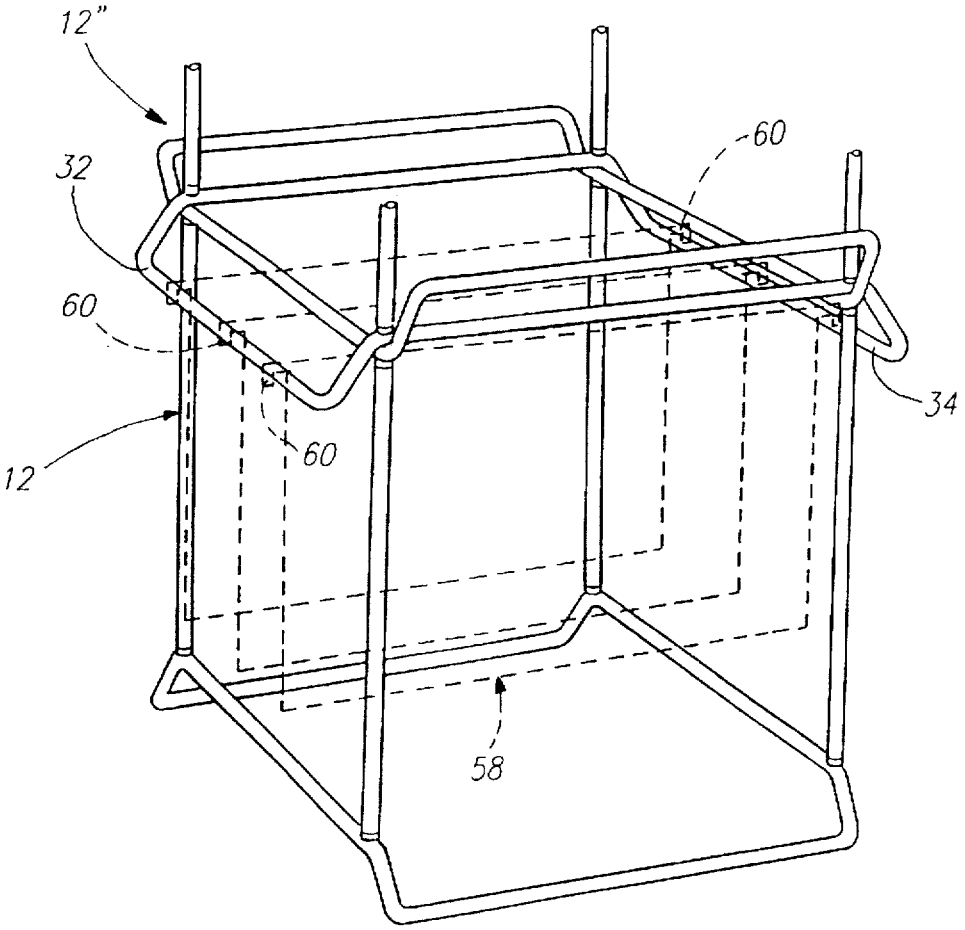
FIG. 4 shows in perspective, partially schematic, view utilization of a modular frame of this invention to support hanging files for documents.

FIG. 4 shows a pair of first modular frames 12 and 12" stacked in a column to be specifically used for maintaining hanging files 58. Hangers 60 on outer edges of the hanging files 58 hook onto the sides 32 and 34 of the lower base of an upper frame 12" and in that way locate the files within the frame central space. File availability is primarily from the top with limited access from the sides.

Figure 7:
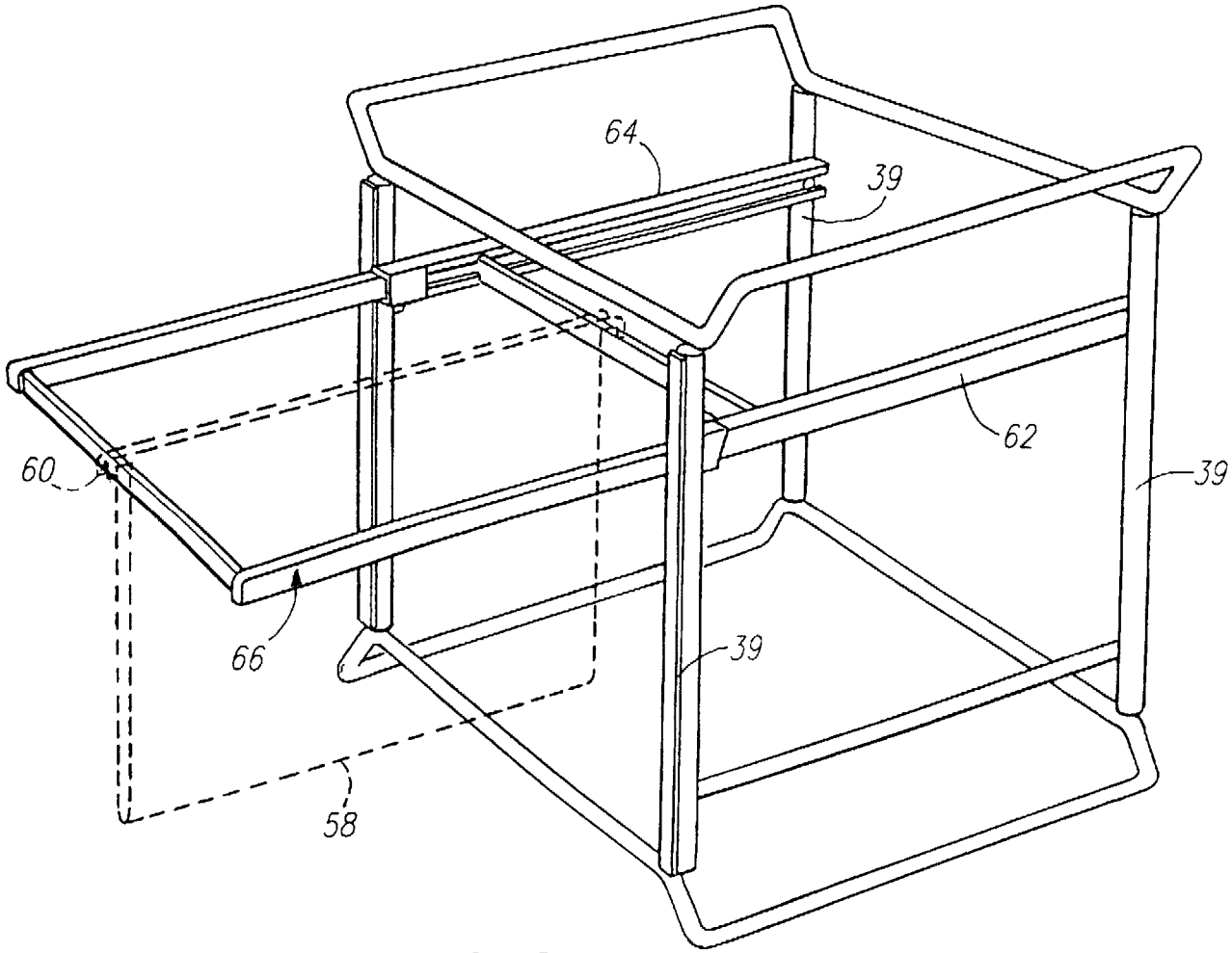
FIG. 7 is an isometric view of a modular frame utilized as a pull-out hanging file for documents.

FIG. 7 shows an alternative form of the system for accommodating hanging files 58, the latter being assumed identical to those hanging files depicted in FIG. 4 having edge hangers 60. In this version, first and second slide rails 62 and 64 are each secured to a pair of adjacent support tubes or rods 39 such that the two slide rails are parallel and spaced apart facing each other across the frame central space. An open center, generally rectangular carriage 66 is slidingly received within the rails 62 and 64 and adjustable from a position fully within the frame central space to a position substantially fully outside frame 12 as shown in FIG. 7. The hangers 60 of each hanging file 58 hook onto opposite sides of carriage 66 as in the FIG. 4 embodiment.

Returning to FIG. 1, shelving elements 18, 18', 18" each consist of an elongated boardlike member of uniform thickness and width. When two first modular frames 12 and 12' are stacked on top of each other in a column the downwardly extending bent end portions of the lower base for 12' form a pair of aligned guide channels 67 and 68 through which a shelving element 18 can pass. Similarly, the shelving element can be received within guide channels in the further column 16'. Still further, the second modular frame 14 when stacked onto a first frame 12 or 12' provides similar guide channels for receiving shelving elements in the manner just described.

When it is desired to interrelate adjacent columns by a shelving element 18" extending at the level of the upper base of the uppermost frame (either 12 or 14), it is necessary to employ a further or third modular frame 70. The latter frame is constructed of a single rod which has its ends welded together, and the so-formed closed loop is bent to provide a first pair of parallel sides 72 and 74 lying in one plane and a second pair of intervening parallel sides 76 and 78 lying in a common plane spaced from one side of the first plane. The third modular frame 70 is so dimensioned that when it is located on the upper base of a topmost frame 14 (e.g., FIG. 1) there are provided a pair of guide channels 80 and 82 for receiving a shelving element 18", for example.

Figure 8:
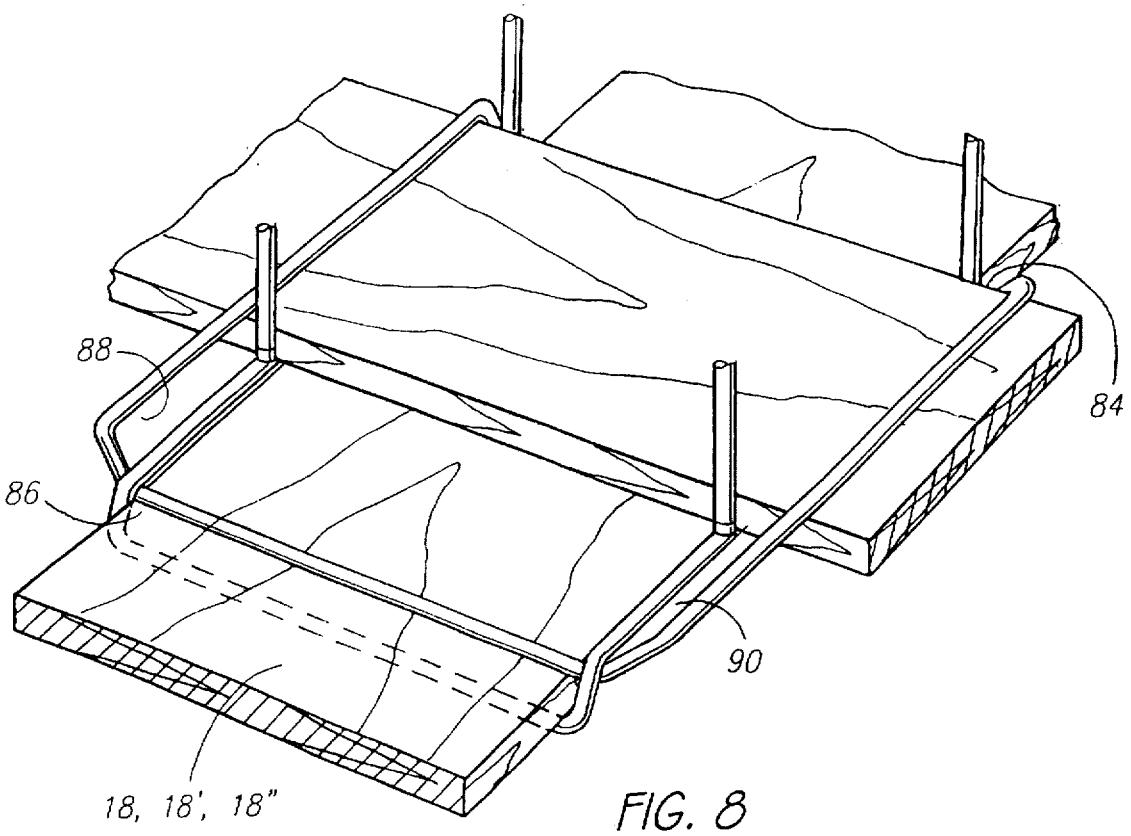
FIGS. 8, 9 and 10 depict isometric, first and second elevational views of shelving elements secured by and locking a pair of stacked modular frames together.
Figure 9:
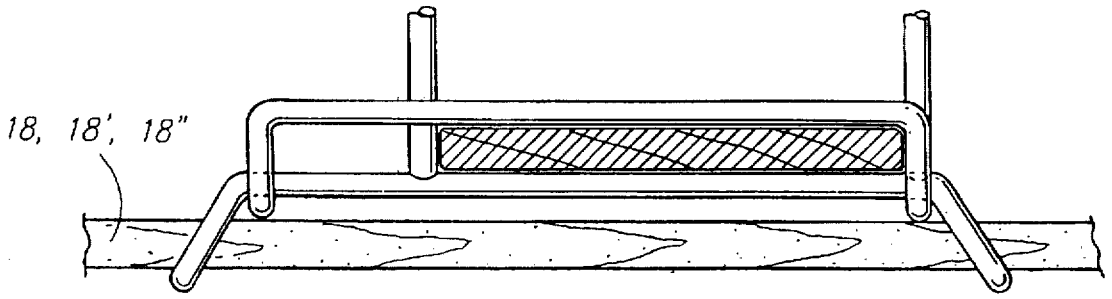
Figure 10:
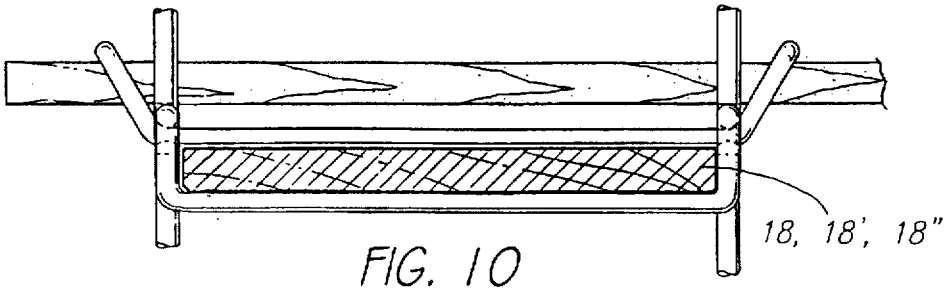

As shown in FIGS. 8–10, wherever a modular frame is assembled onto another modular frame there are two orthogonal sets of aligned guide channels which enable two vertically spaced shelving elements 18, 18', 18" to be secured to the assembled frames and extend at 90-degrees to each other. The pairs of channels are 84–86 and 88–90 (FIG. 8). This capability is especially advantageous where the described system must accommodate an inner corner of a room, for example, or it is otherwise desirable to provide an overall L-shape to the space system.

Figure 11:
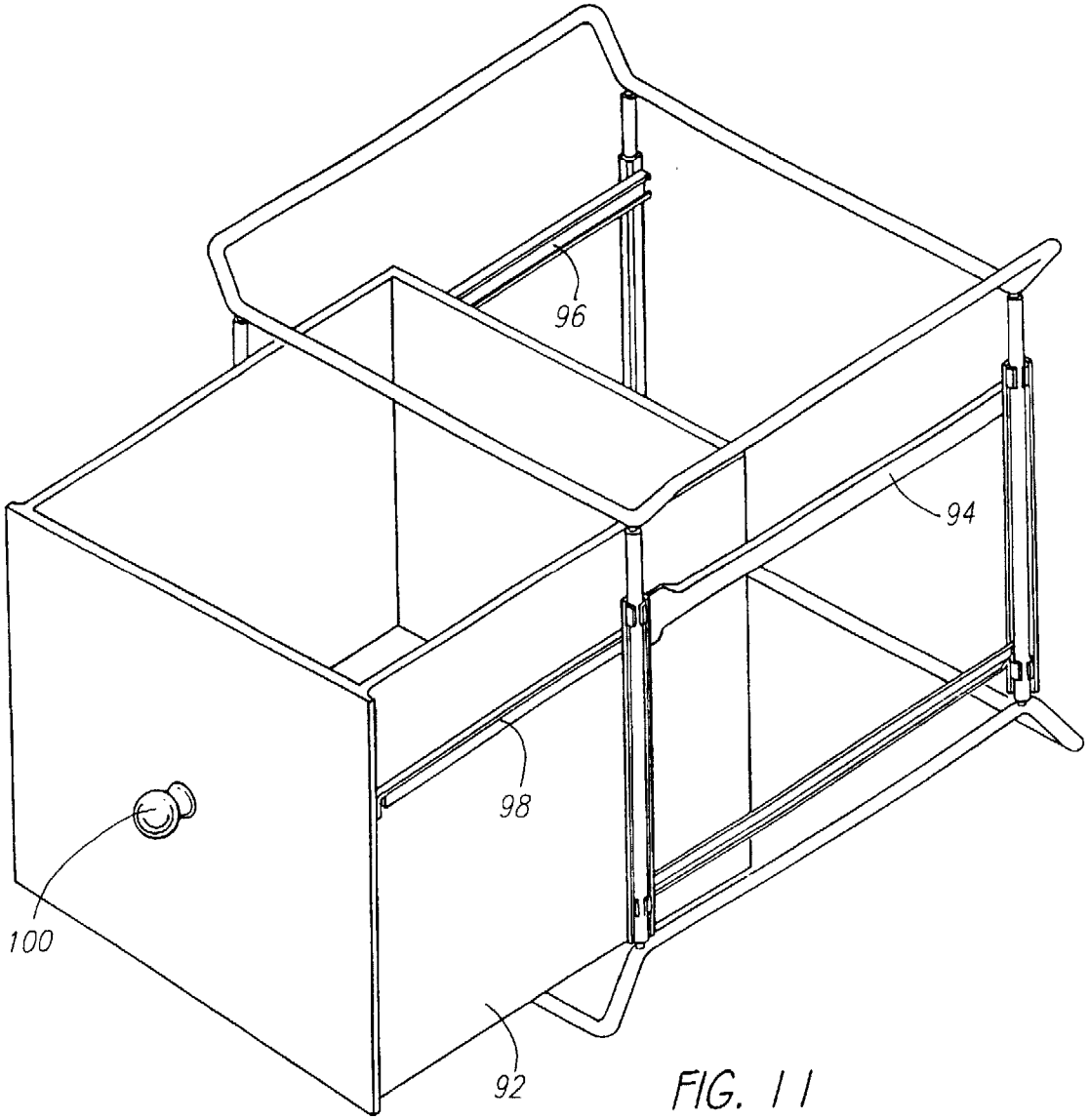
FIG. 11 is a perspective view of a modular frame adapted to include a drawer.

Turning now to FIG. 11 there is shown a first modular frame 12 modified to receive an open-top drawer 92 therein. More particularly, first and second slide rails 94 and 96 are secured to support tubes 56 on opposite sides of the frame which slidingly mate with respective slide inserts 98 on the two opposite outer sides of the drawer. The drawer may be slid into and out of the internal frame space by use of knob 100.

Figure 13:
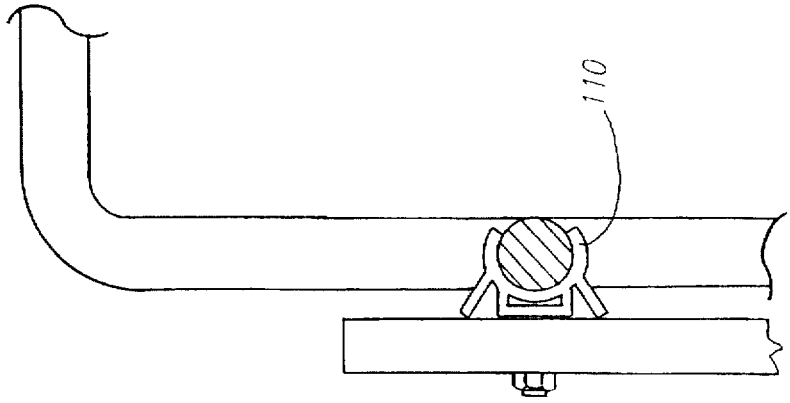
FIGS. 13, 14 and 15 depict elevational, partially sectional views of swinging door mounting means for the compartment of FIG. 12.
Figure 12:
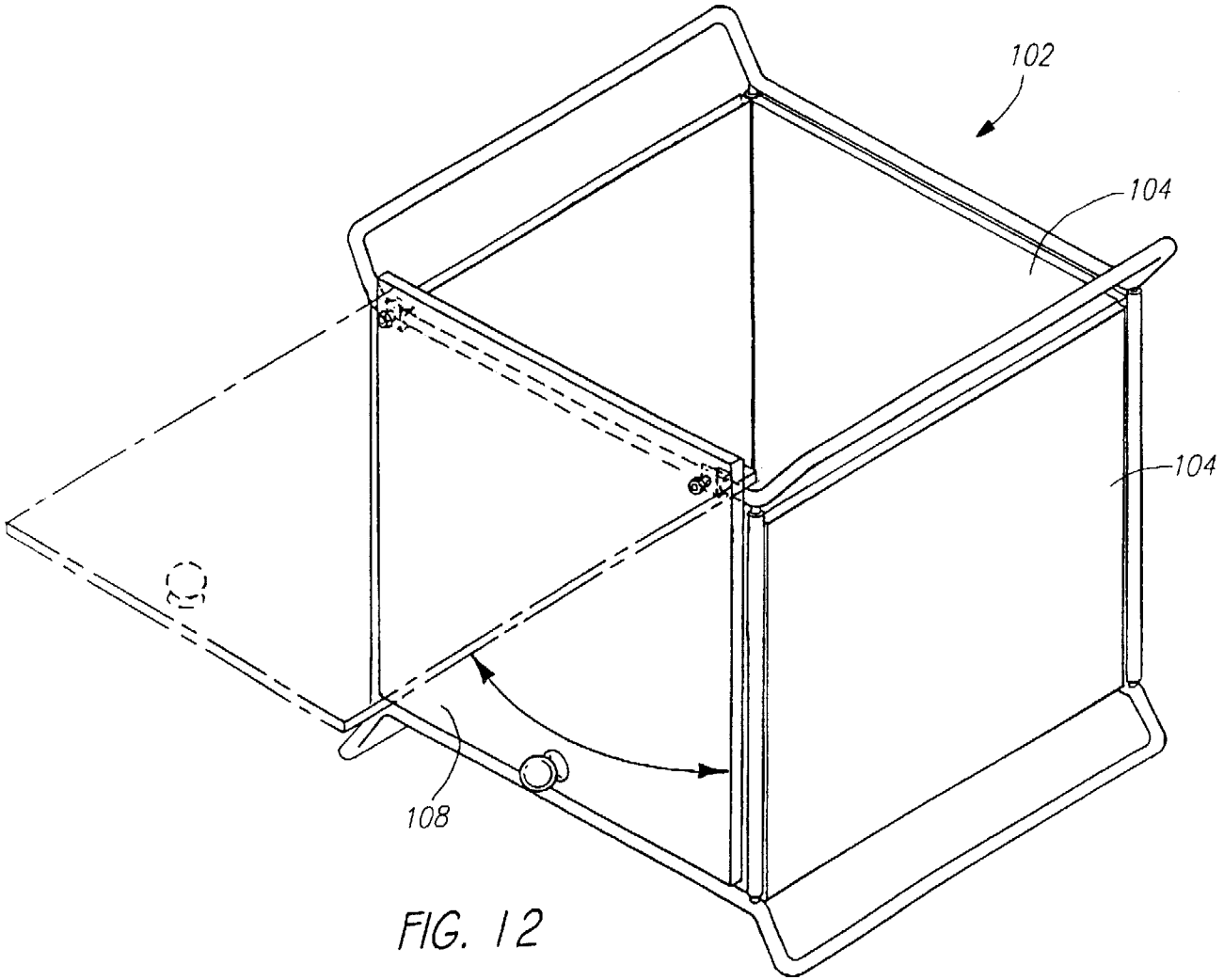
FIG. 12 is a perspective view of a modular frame adapted to provide a compartment with swinging door access.
Figure 14:
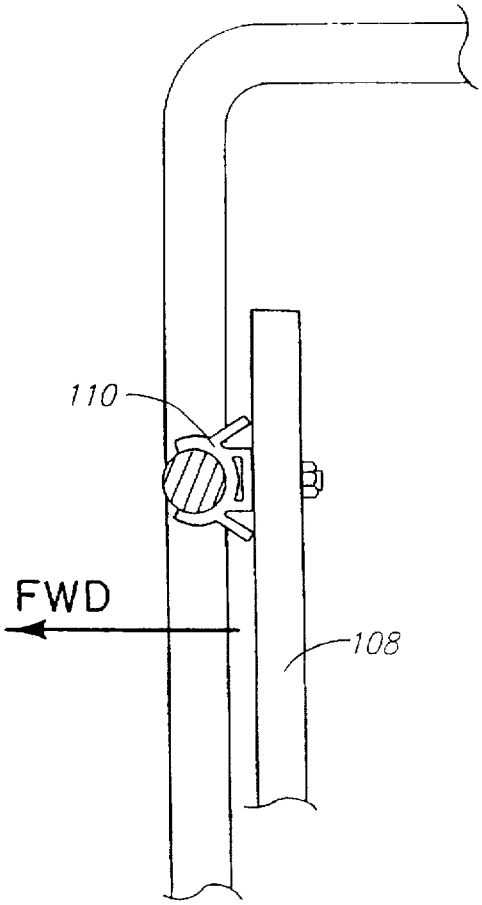
Figure 15:
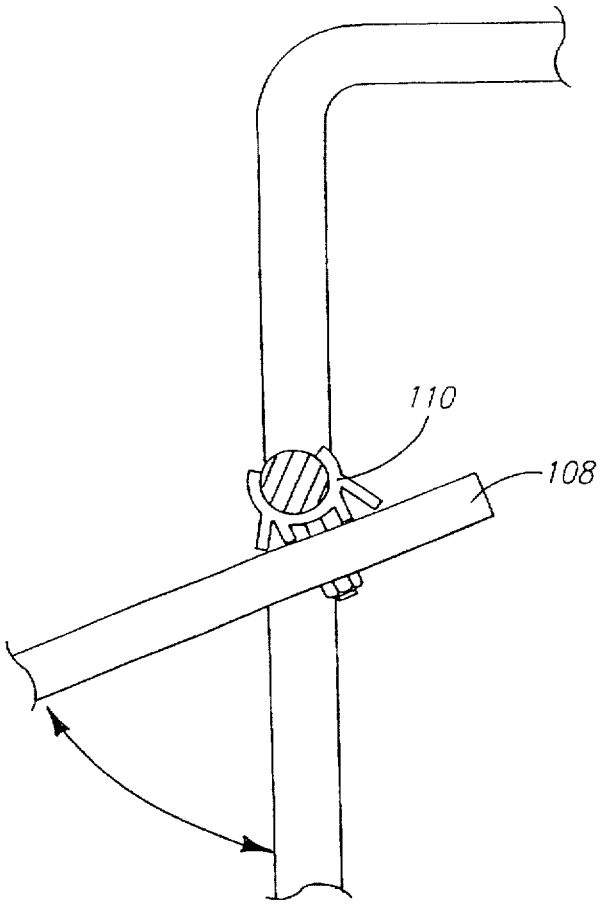

It may be desirable to utilize one or more modular frames as a closed compartment 102 as shown in FIG. 12. Sidewall 104 and bottom panels are removably secured to the base sides and support tubes by spring clips. The access side is closed off by a door 108 which is swingably mounted onto a modular frame upper base side by a pair of open-sided segmental spring clips 110. The clips may be either mounted on an inner surface of the door 108 (FIG. 13) or on its outwardly directed surface (FIGS. 14, 15).

Figure 16:
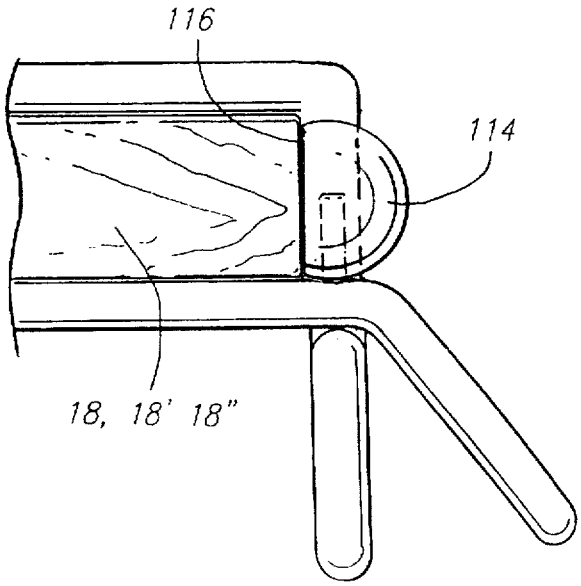
FIGS. 16 and 17 show in elevational view two forms of end finishings for receipt on the exposed end of a stub shaft.
Figure 17:
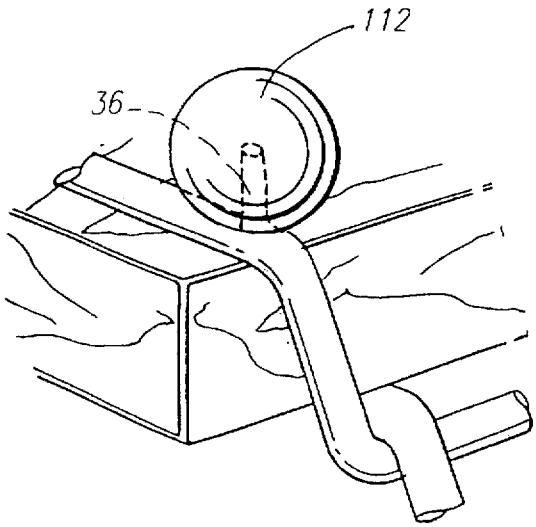

On building up a column of modular frames as described, on reaching the topmost modular frame there will be four upwardly extending stub shafts 36 left without associated support rods fitted thereon. FIG. 17 depicts a safety sphere 112 having an opening therein enabling fitting receipt onto the stub shaft. Where a shelving element 18, 18', 18" is located in obstructing relation so that a sphere 112 cannot be used, a semispherical element 114 includes an opening for fitting receipt onto the stub shaft 36 with a flat side 116 facing toward the shelving element (FIG. 16).

Figure 18:
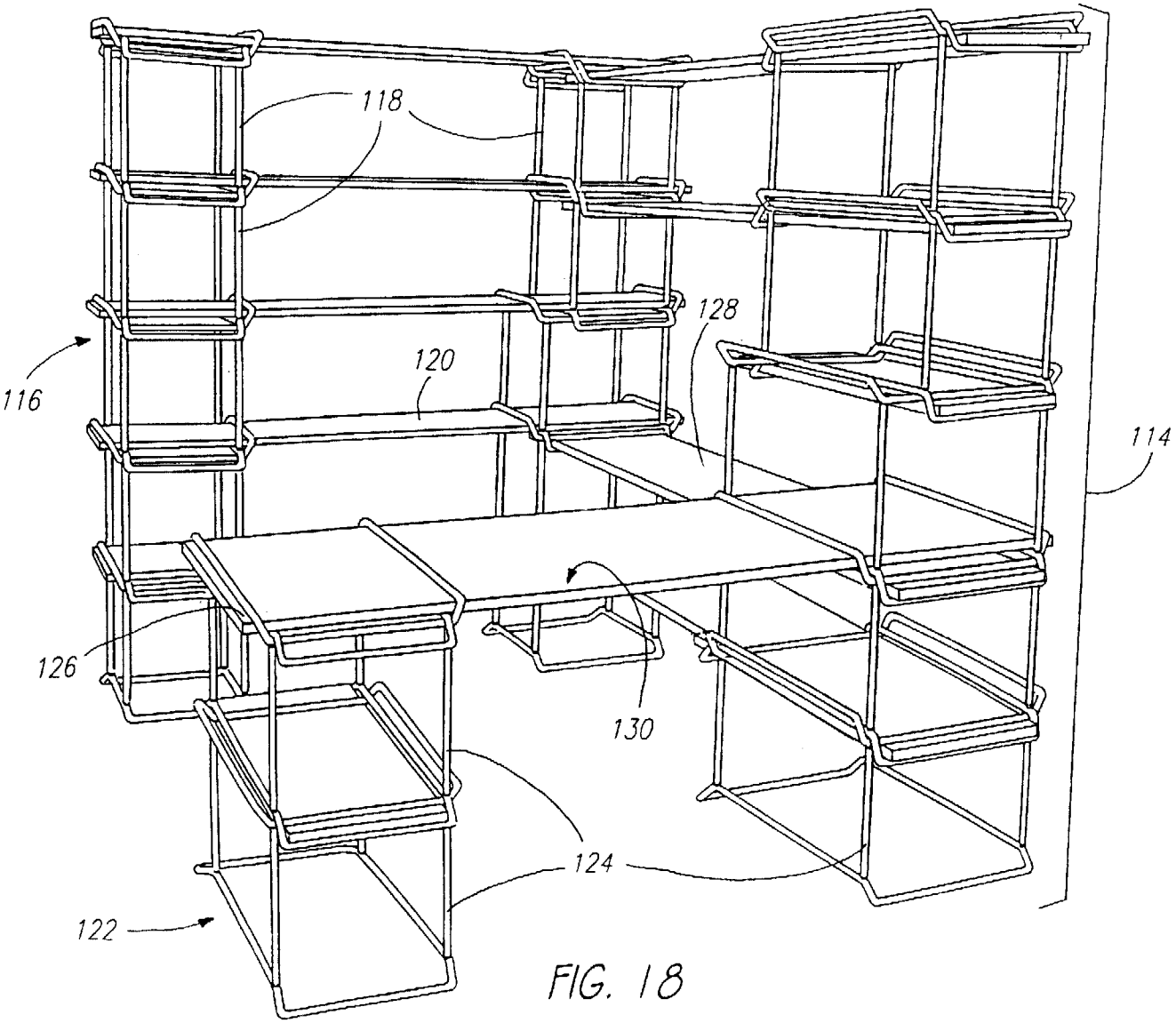
FIG. 18 is a perspective view of a system formed from individual columns of different dimensioned modular frames.

In the preceding description, it has been assumed that all modular frames 12 would be the same size. Also, although the modular frame 14 has an offset so that its cross-sectional dimensions are specified as less than those of the frame 12, the frames 14 have only been presented to this point as of a fixed single size. It is advantageous to make these modular frames in different-sized sets so as to enhance flexibility particularly by using different size modular frames in the same system. By way of significant example reference is made to FIG. 18 where a generally U-shaped system 114 is shown. More particularly, one arm 116 of the system is constructed of modular frames 118 which are dimensioned to support a shelving element 120 that is 12 inches wide; the other arm 122 is constructed of modular frames 124 dimensioned to handle shelving elements 126 which are 24 inches in width; and shelving elements 128 of medium width (e.g., 16 inches) interconnecting the two arms.

The larger modular frames 124 can be used to form a desktop or relatively large tabletop surface 130 in view of the wide shelving element 126. The well of the desk is formed by leaving a space between adjacent columns in arm 122. The first arm 116 having the narrowest shelving elements can accommodate smaller objects, while the medium shelving 128 will accommodate modest sized objects (e.g., television, computer monitor). The entire assemblage may be extended along a single wall, adjacent a corner forming an "L", or centrally located in a room providing 360 degree access.

Although the invention has been described in connection with a preferred embodiment, it is to be understood that one skilled in the art may effect modifications that come within the spirit of the invention as described and within the ambit of the appended claims.

What is claimed is:

1. A modular space system comprising:

a first lower frame having a first lower base and a first upper base, the first lower base and the first upper base being substantially parallel and coupled together in longitudinally-spaced relation to each other; and a first upper frame having a second lower base and a second upper base, the second lower base and the second upper base being substantially parallel and coupled together in longitudinally-spaced relation to each other, the second lower base having a width and depth equal to the width and depth of the first upper base and resting on the first upper base to interlock the first lower frame and the first upper frame, the second upper base having a width equal to the width of the second lower base and having a depth that is less than the depth of the second lower base.

2. The modular space system according to claim 1 further comprising:

a second lower frame having a third lower base and a third upper base, the third lower base and the third upper base being substantially parallel and coupled together in longitudinally-spaced relation to each other;

a second upper frame having a fourth lower base and a fourth upper base, the fourth lower base and the fourth upper base being substantially parallel and coupled together in longitudinally-spaced relation to each other, the second lower and upper frames being spaced laterally from the first lower and upper frames; and a plurality of boards having various selected depths, the boards extending between, and being supported by, the laterally spaced first and second lower frames and the first and second upper frames to create a plurality of horizontal surfaces.

3. The modular space system according to claim 1, further comprising:

a horizontal rail coupled to a first vertical member at a first end and to a second vertical member at a second end, the first and second vertical members being adapted to be selectively snapped onto and off of either of the first lower frame or the first upper frame, the horizontal rail slidably receiving a carriage, the carriage being movable along the horizontal rail from a first position substantially within the first lower or upper frame to a second position substantially outside the first lower or upper frame.

4. The modular space system according to claim 3 wherein the carriage is adapted to suspend a plurality of file folders such that the file folders move substantially from the first position to the second position with the carriage.

5. The modular space system according to claim 3 wherein the carriage is coupled to a drawer such that the drawer moves substantially from the first position to the second position with the carriage.

6. The modular space system according to claim 1 further comprising a plurality of panels removably attached to either of the first upper frame or the first lower frame to enclose a space within the frame, and a door hingedly mounted to the frame to selectively provide and restrict access to the space within the frame.

7. A modular space system comprising:

a first lower frame having a first lower base and a first upper base, the first lower base and the first upper base being substantially parallel and coupled together in longitudinally-spaced relation to each other;

a first upper frame having a second lower base and a second upper base, the second lower base and the second upper base being substantially parallel and coupled together in longitudinally-spaced relation to each other, the second lower base resting on the first upper base to interlock the first lower frame and the first upper frame; and a horizontal rail coupled to a first vertical member at a first end and to a second vertical member at a second end, the first and second vertical members being adapted to be selectively snapped onto and off of either of the first lower frame or the first upper frame, the horizontal rail slidably receiving a carriage, the carriage being movable along the horizontal rail from a first position substantially within the first lower or upper frame to a second position substantially outside the first lower or upper frame.

8. The modular space system according to claim 7 wherein the carriage is adapted to suspend a plurality of file folders such that the file folders move substantially from the first position to the second position with the carriage.

9. The modular space system according to claim 7 wherein the carriage is coupled to a drawer such that the drawer moves substantially from the first position to the second position with the carriage.

10. The modular space system according to claim 7 further comprising a plurality of panels removably attached to either of the first upper frame or the first lower frame to enclose a space within the frame, and a door hingedly mounted to the frame to selectively provide and restrict access to the space within the frame.

11. The modular space system according to claim 7 further comprising:

a second lower frame having a third lower base and a third upper base, the third lower base and the third upper base being substantially parallel and coupled together in longitudinally-spaced relation to each other;

a second upper frame having a fourth lower base and a fourth upper base, the fourth lower base and the fourth upper base being substantially parallel and coupled together in longitudinally-spaced relation to each other, the fourth lower base resting on the third upper base, the second lower and upper frames being spaced laterally from the first lower and upper frames; and a plurality of boards having various selected depths, the boards extending between, and being supported by, the laterally spaced first and second lower frames and the first and second upper frames to create a plurality of horizontal surfaces.

12. A modular space system comprising:

a first lower frame having a first lower base and a first upper base, the first lower base and the first upper base being substantially parallel and coupled together in longitudinally-spaced relation to each other;

a first upper frame having a second lower base and a second upper base, the second lower base and the second upper base being substantially parallel and coupled together in longitudinally-spaced relation to each other, the second lower base resting on the first upper base to interlock the first lower frame, and the first upper frame;

a second lower frame having a third lower base and a third upper base, the third lower base and the third upper base being substantially parallel and coupled together in longitudinally-spaced relation to each other;

a second upper frame having a fourth lower base and a fourth upper base, the fourth lower base and the fourth upper base being substantially parallel and coupled together in longitudinally-spaced relation to each other, the fourth lower base resting on the third upper base, the second lower and upper frames being spaced laterally from the first lower and upper frames;

a plurality of boards having various selected depths, the boards extending between, and being supported by, the laterally spaced first and second lower frames and the first and second upper frames to create a plurality of horizontal surfaces; and a horizontal rail coupled to a first vertical member at a first end and to a second vertical member at a second end, the first and second vertical members being adapted to be selectively snapped onto and off of either of the first lower frame or the first upper frame, the horizontal rail slidably receiving a carriage, the carriage being movable along the horizontal rail from a first position substantially within the first lower or upper frame to a second position substantially outside the first lower or upper frame.

13. The modular space system according to claim 12 wherein the carriage is adapted to suspend a plurality of file folders such that the file folders move substantially from the first position to the second position with the carriage.

14. The modular space system according to claim 12 wherein the carriage is coupled to a drawer such that the drawer moves substantially from the first position to the second position with the carriage.

15. The modular space system according to claim 12 further comprising a plurality of panels removably attached to either of the first upper frame or the first lower frame to enclose a space within the frame, and a door hingedly mounted to the frame to selectively provide and restrict access to the space within the frame.

* * * * *